US005611126A

United States Patent [19]

Relly

[11] Patent Number: 5,611,126

[45] Date of Patent: Mar. 18, 1997

[54] CASKET AND FABRIC RETAINER MEMBERS THEREFOR

[76] Inventor: Robert H. Relly, 4851 Wolfe Rd., Richmond, Ind. 47374

[21] Appl. No.: 525,306

[22] Filed: Sep. 8, 1995

[51] Int. Cl.[6] ..... A61G 17/00

[52] U.S. Cl. ..... 27/19; 27/2

[58] Field of Search ..... 27/1, 2, 19, 29, 27/35; 52/710, 773; 160/330, 327, 38, 383, 391, 397

[56] References Cited

U.S. PATENT DOCUMENTS 3,014,261 12/1961 Nelson ..... 27/19

3,228,085 1/1966 Nelson ..... 27/19

FOREIGN PATENT DOCUMENTS 763155 7/1967 Canada ..... 27/19

*Primary Examiner*—Kien T. Nguyen

*Attorney, Agent, or Firm*—R. William Graham

[57] ABSTRACT

The present invention is directed to a burial casket having a housing having a pocket surface portion, a piece of decorative fabric contacting said pocket surface portion and a resilient flexible retainer member bendably seated within the pocket surface and in a manner such that the fabric is frictionally held between the retainer member and the pocket surface portion, wherein the retainer member has a ribbed surface portion formed on a surface thereof.

10 Claims, 1 Drawing Sheet

CASKET AND FABRIC RETAINER MEMBERS THEREFOR

BACKGROUND OF THE INVENTION

1. Field of Invention

The present invention relates generally to the field of burial caskets. More particularly, the invention is directed to a burial casket having improved means for retaining fabric therein.

2. Related Art

There exist many types of burial caskets which are usually made from one of wood, metal, plastic, or composite material. It is common to line the interior of the burial casket with a decorative fabric lining.

Such fabric lining has heretofore been attached to the interior of such burial caskets through such techniques as tacking, gluing and/or snapping, for example, depending upon the construction of the burial casket.

Such prior techniques are time consuming, costly and can be hazardous to the installer, i.e. can result in cuts in the tacking or snapping process. There remains therefore a need to provide an improved casket with means for attaching lining fabric which is quicker, easier and safer for use by the installer while providing an effective attachment.

SUMMARY OF THE INVENTION

It is an object to improve burial caskets.

It is another object to simplify the ease of constructing a burial casket which has fabric lining.

Still another Object is to improve the means for attaching fabric to a burial casket.

Accordingly, the present invention is directed to a burial casket having a housing, wherein the housing has a pocket surface portion, a piece of fabric contacting the pocket surface portion and a resilient flexible retainer member bendably seated within the pocket surface and against the fabric in a manner to hold the fabric in place. The fabric retainer member having a ribbed surface portion formed on the surface thereof and preferably being made from a plastic material.

The pocket surface portion includes a lip portion to receive the fabric, and a seating surface portion. The retainer member has an end disposed against the seating surface and another end disposed against the fabric and lip portion.

Other objects and advantages will be readily apparent from reading the following description, drawings and claims appended hereto.

DETAILED DESCRIPTION OF THE PREFERRED EMBODIMENT

Figure 1:
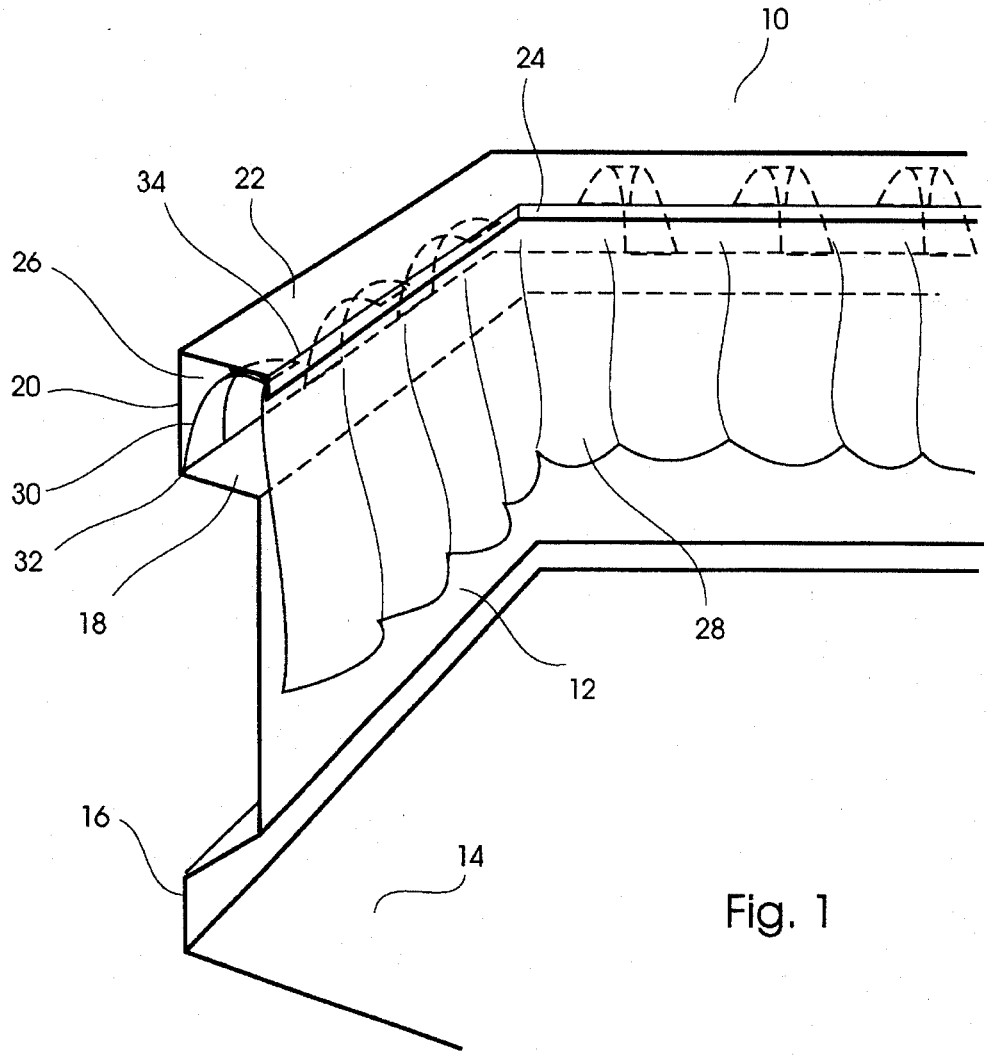
FIG. 1 is a partial cross-sectional perspective of a burial casket of the present invention.

Referring to the now to the drawings, the burial casket of the present invention is generally referred to by the numeral 10. The burial casket 10 includes four sides 12 connected to a bottom 14 by way of a base rail 16. Each of the sides 12 includes an upper edge 18 which is connected to a side flange 20 which is in turn connected to a top flange 22 which is in turn connected to a downwardly extending lip portion 24. Together, the upper edge 18, side flange 20, top flange 22 and lip portion 24 form a pocket surface 26 to receive a portion of fabric material 28 and retainer members 30.

Figure 2:
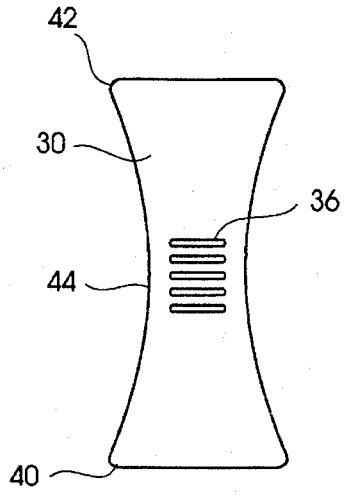
FIG. 2 is a front view of a retainer member of the present invention.
Figure 3:
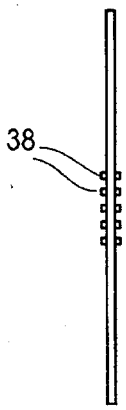
FIG. 3 is a side view of the retainer member of the present invention.

The retainer members 30 are flexible and resilient in construction and are preferably made of a plastic material, however, may be of any suitable material which is formed in a manner to accomplish their use described herein. Each retainer member 30 is of a length greater than a diagonal distance between a corner surface 32 formed between the upper edge 18 and the side flange 20 and another corner surface 34 formed between the top flange 22 and lip portion 24. Each retainer member 30 is formed with a gripping surface 36 which includes a plurality of raised ribbed surface portions 38, as shown in FIGS. 2 and 3, which extend from both sides of the retainer member 30 and are laterally spaced from one another about a mid portion of the retainer member 30. The number, size and geometry of ribbed surfaces 38, can be of a type which enables the user to readily accomplish insertion of the retainer members 30 into the pocket surface 26 in a manner to securely attach the fabric 28. The retainer members 30 are preferably formed with smooth surfaces to prevent cuts during handling and installation. In this regard, the ribbed surfaces 38 are provided such that an installer can accomplish the installation by handling the ribbed surfaces 38. Also, sides 44 are slightly arcuate for the purpose of enabling a spring effect forcing constant surface contact between the ends of the retainer member 30 and the corner surfaces 32 and 34.

The present invention operates in the following manner. When installing a decorative fabric lining material into the burial casket 10, the portion 28 of the fabric, constituting an upper edge, is placed inside the pocket surface 26 in a manner such that the portion 28 is adjacent the surface of the top flange 22 and the lip portion 24.

In a spaced relation to one another, retainer members 30 are individually inserted into the pocket surface 26 to hold the fabric in place in the following manner. Each retainer member 30 is gripped with a finger and thumb on the gripping surface 36. An end 40 of the retainer member 20 is disposed against the corner surface 32 with the portion 28 of the fabric disposed adjacent between another end 42 and top flange 22 and lip portion 24. Using the gripping surface 36, concurrent pressures are applied, one in a downward manner on the end 40 toward the corner surface 32 and another toward the side flange 20. With sufficient pressures, the retainer member 30 bends causing the end 42 to be drawn into the pocket surface 26 and seating within the corner surface 34 having the fabric portion 28 frictionally engaged between the end 42 and the corner surface 34. The number and spacing of the retainer members 30 will vary with the type of fabric to be retained with the requirement that a sufficient number and spacing be employed to securely hold the fabric in place.

While the present invention has been set forth above in a preferred embodiment, it is contemplated that other modifications, improvements and derivations will be readily apparent to those killed in the art. Accordingly, the appended claims hereto should be accorded the full scope of protection of any such modifications, derivations and improvements.

What is claimed is:

1. A burial casket, comprising:

a housing having a pocket surface portion;

a piece of decorative fabric contacting said pocket surface portion; and a resilient flexible retainer member having a first end, a second end and a longitudinal section therebetween, bendably seated within the pocket surface and in a manner such that said piece of fabric is frictionally held between said first end of said retainer member and said pocket surface portion, wherein said retainer member further has at least one transverse ribon said longitudinal section thereof to aid in insertion of said retainer member into said pocket surface portion.

2. The burial casket of claim 1, wherein said retainer member is formed of a plastic material.

3. The burial casket of claim 1, wherein said pocket surface portion includes a lip portion to receive said piece of fabric and a seating surface portion, wherein said retainer member has said second end disposed against said seating surface portion and said first end disposed adjacent said lip portion and having said piece of fabric frictionally engaged between said lip portion and said first end.

4. The burial casket of claim 3, wherein said retainer has a length greater than a distance between said lip portion and said seating surface.

5. The burial casket of claim 4, wherein said retainer member has two sides, said transverse rib formed on each of said two sides.

6. The burial casket of claim 1, wherein the longitudinal section has arcuate sides.

7. A burial casket, which includes:

a housing having four interconnecting sides, each side having an upper edge and a lower edge, a base connected to said lower edges, a side flange connected to each said upper edge, a top flange connected to each said side flange and a lip portion connected to each said top flange, wherein said upper edge, said side flange, said top flange and said lip portion form a pocket surface;

a fabric material partially disposed within said pocket surface; and a retainer member having a first end, a second end and a longitudinal section therebetween, at least one transverse rib formed on said longitudinal section seated within said pocket surface in a manner to fixably retain a portion of said fabric frictionally between said first end of said retainer member and said pocket surface and to aid in the insertion of said retainer member into said pocket surface.

8. The burial casket of claim 7, wherein said retainer member has two sides, said transverse rib formed on each or said two sides.

9. The burial casket of claim 7, wherein said retainer member is formed of a plastic material.

10. The burial casket of claim 7, wherein the longitudinal section has arcuate sides.

* * * * *